US005439390A

United States Patent [19]

Raynor et al.

[11] Patent Number: 5,439,390

[45] Date of Patent: Aug. 8, 1995

[54] POWER CORD

[76] Inventors: Emmett S. Raynor, 365 E. Connecticut Ave.; Alan C. Walters, 142 Bridgewater Dr., both of Southern Pines, N.C. 28387

[21] Appl. No.: 36,507

[22] Filed: Mar. 24, 1993

[51] Int. Cl.[6] ..... H01R 11/00; H01R 35/00

[52] U.S. Cl. ..... 439/502; 439/507; 439/491

[58] Field of Search ..... 439/491, 502–505

[56] References Cited

U.S. PATENT DOCUMENTS 4,820,193 4/1989 Noorily ..... 439/491
4,917,626 4/1990 Barton ..... 439/502
4,955,822 9/1990 Look et al. ..... 439/505
5,004,433 4/1991 Daoud ..... 439/502

*Primary Examiner*—P. Austin Bradley

[57] ABSTRACT

This invention is an improved power cord having a central head portion and a plurality of generally equal length leg portions connected thereto. At least one of the leg portions terminates at its end opposite the head portion in a male plug and the remainder of the leg portions terminate in female plugs. The leg portions of the improved power cord can be coiled from the head portion to the plugs for storage and yet can be readily deployed for use without tangling. Also, a plurality of female plugs are provided in the head portion.

9 Claims, 3 Drawing Sheets

POWER CORD

FIELD OF INVENTION

This invention relates to electrical conducting means and more particularly to electrical power cords.

BACKGROUND OF INVENTION

Whenever multiple extension cords are required such as on construction work sites, the usual method is for the cords to be plugged into a power source which can be either a temporary service or a permanent service. The extension cords are then pulled to the work area which can be either a relatively fixed location such as a work bench site for a bench saw, radial arm saw, or the like, or it can be any other location where an electric hand saw, electric drill or other tools are needed.

With several workers on the site using different electrical tools, the extension power cords can crisscross the work site forming a maze of cords. When a worker needs a certain tool, he must either know where he left it or search the site to find the same. This, of course, is time consuming which equates into time lost in accomplishing the job at hand.

At the end of the workday, the tools must be put up and all of the cords taken up and in some manner coiled or looped for storage. The larger the site the more tools and cords must be put up and the longer it takes to accomplish this.

From the above it can be seen that on any given work location a considerable amount of time must be spent spreading the power cords out at the beginning of the day and a like amount of time must also be spent at the end of the day taking the cords back up.

BRIEF DESCRIPTION OF INVENTION

After much research and study into the above-mentioned problems, the present invention has been developed to provide a power cord with a plurality of legs of substantially equal length. One of these legs is a service cable with a male plug on the end thereof. The other legs are extension legs which terminate in female plugs. All of the legs are integrally connected at a fan-shaped central connector that somewhat resembles the head of a squid with tentacles or legs extending therefrom. A plurality of female plugs are also provided in the squid head.

Each of the cord legs are either of a different color or have different colored stripes formed thereon so that each cord can be identified as going to a certain type of electrical tool. An example of this would be having the main power source cord orange, the leg cord used in conjunction with a portable saw could be yellow, the cord leg used in conjunction with electric drills could be green, etc.

The common juncture or squid head would also preferably be the same color as the power source cord.

If the length to the cord legs are 40 feet from the squid head then the total distance from the power source to the end of the extension cord legs could be as much as 89 feet. If the legs are 50 feet, then they could extend to a work site 100 feet from the power source which lends even more versatility to the present invention.

DISCUSSION OF PRIOR ART

The following references represent the closest prior art of which the inventors are aware and is intended to meet the requirements of 37 CFR 1.98 for Information Disclosure Statements:

List of References

U.S. Pat. No. 4,955,822 Issue date: Sep. 11, 1990 Inventors: Robert O. Look and Deborah M. Pittman U.S. Pat. No. 2,979,624 Issue date: Apr. 11, 1961 Inventor: Wilby Askerneese U.S. Pat. No. 4.941,845 Issue date: Jul. 17, 1990 Inventor: Mark Eppley and Peter B. Rysavy Assignee: Traveling Software, Inc.

U.S. Pat. No. 3,535,638 Issue date: Oct. 20, 1970 Inventor: Nilo A. Michelin

U.S. Pat. No. 4,500,150 Issue date: Feb. 19, 1985 Inventors: Robert L. Leibensperger and Donna C. Leibensperger U.S. Pat. No. 4,965,877 Issue date: Oct. 23, 1990 Inventor: Dennis R. Gunn

Concise Explanation of References

U.S. Pat. No. 4,955,822 to Look and Pittman discloses two extension cords terminating in a common juncture with a male plug associated therewith so that the juncture can be plugged into the power source. The juncture also serves as a storage reel for the cords extending outwardly therefrom.

U.S. Pat. No. 2,979,624 to Askerneese discloses a remote control extension cord with a male plug on one end and multiple female plugs on the other end with a plurality of push buttons on an additional extension so that the female plugs can be turned on and off to control lights, television sets, and the like.

U.S. Pat. No. 4,941,845 to Eppley and Rysavy discloses a data transfer cable with a plurality of cables that are interconnected so that serial and parallel connections can be made between various computer terminals.

U.S. Pat. No. 3,535,638 to Michelin discloses a test cable including a juncture with two cables extending outwardly therefrom. This disclosure is a highly specialized cable arrangement for testing or repairing television receiver sets.

U.S. Pat. No. 4,500,150 to Leibensperger and Leibensperger is considered of interest in that it discloses an extension cord with a storage reel, a plurality of female outlets and switches to control each outlet so multiple household appliances can be plugged thereinto.

U.S. Pat. No. 4,965,877 to Gunn discloses a system for supplying DC power to musical effect units but otherwise is not considered particularly pertinent.

OBJECTS OF INVENTION

In view of the above it is an object of the present invention to provide a power source cord and a plurality of extension cords connected at a squid-shaped terminal having an additional plurality of female plugs therein.

Another object of the present invention is to provide a power cord with a plurality of legs of substantially equal length, one leg terminating in a male and the other legs terminating in female plugs.

Another object of the present invention is to provide a power cord with a plurality of legs of different colors integrally connected in a power head.

Another object of the present invention is to provide a plurality of power cords interconnected at a central point with each leg being either of a different color or having a different colored strip appearing thereon.

Another object of the present invention is to provide a plurality of generally equal length power cords integrally connected at a fan or squid-shaped head which can be readily coiled for storage.

Another object of the present invention is to provide a juncture with a plurality of equal length cord-like extensions extending therefrom which will not tangle when thrown to uncoil the same.

Another object of the present invention is to provide an electrical extension cord unit including a power source cord and a plurality of generally equal length extension cords interconnected at a central head which can be readily coiled for storage and which can also be heaved to uncoil the same without intertwining or tangling.

Other objects and advantages will become apparent and obvious from a study of the following description and accompanying drawings which are merely illustrative of such invention.

DETAILED DESCRIPTION OF INVENTION

With further reference to the drawings, the improved power cord of the present invention, indicated generally at 10, includes a head portion 11 made from a relatively rigid, molded dielectic material. This head portion is generally fan or squid-shaped and includes three female electrical receptables 12 in the end thereof. A molded handle portion 13 formed from a flexible dielectic material is attached to the end of head portion 11 opposite the female receptables 12.

Figure 1:
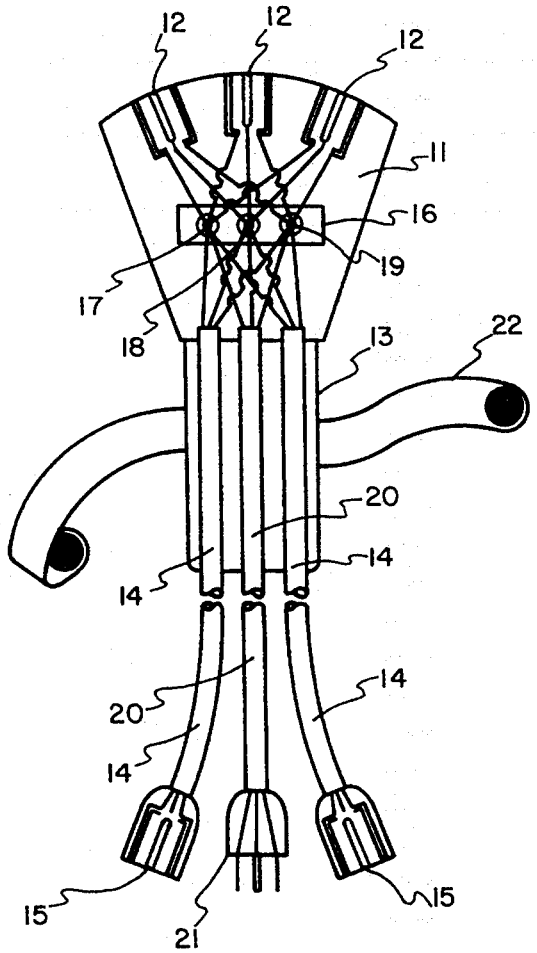
FIG. 1 is a schematic view of the improved power cord of the present invention.

A pair of extension cord legs 14 are provided with female receptacles 15 being provided on one end thereof. The other end of each of these extension cord legs passes through the handle portion 13 and is wired to a terminal block 16 as shown schematically in FIG. 1. Each of the cords 14 has a positive lead wire 17, a common ground lead wire 18, and a neutral lead wire 19.

A service cord leg 20 is also provided and is basically the same length as the extension cord legs 14. The service cord leg has a male plug 21 at one end with the opposite end passing through handle portion 13 and being connected to terminal block 16 in head portion 11 again, as can clearly be seen in FIG. 1.

A strap 22 is formed from hook and loop type material such as the material sold under the brand name Velcro. This strap is at one point secured to handle portion 13 and has the dual purpose of holding the cords in coiled position during storage while also allowing the head and handle portion to be secured to a work station during use as will hereinafter be described in greater detail.

Figure 2:
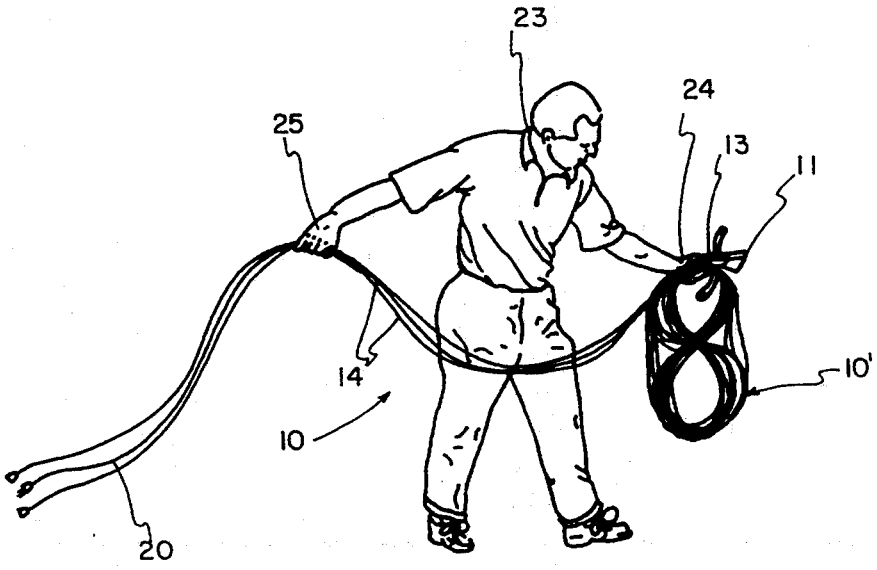
FIG. 2 is a perspective view of the cord of the present invention being coiled for storage.

To coil the improved power cord 10 of the present invention, righthanded user 23 will hold the handle portion 13 in his left hand 24 and reach behind him with his right hand 25 grasping the extension and service cords and pulling them back to his left hand in a manner similar to a sailor coiling a line or a surveyor coiling a measuring tape. This process is repeated until the entire improved power cord 10 is coiled. The Velcro strap 22 can then be wrapped around the coiled cord 10 holding the same in that position during storage. The coiling of the improved power cord 10 is clearly shown in FIG. 2.

Figure 3:
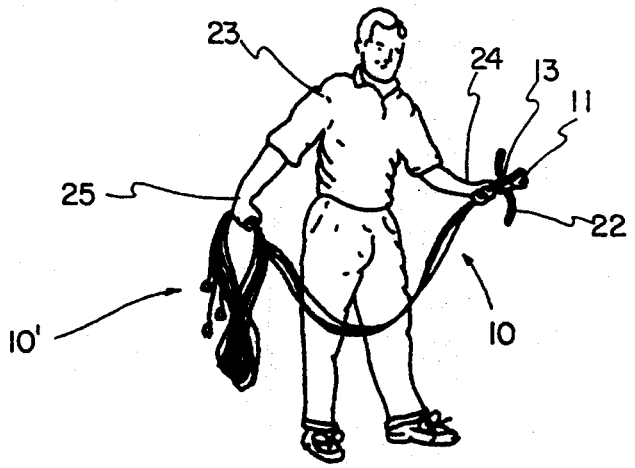
FIG. 3 is a perspective view of the coiled cord being readied for heaving.
Figure 4:
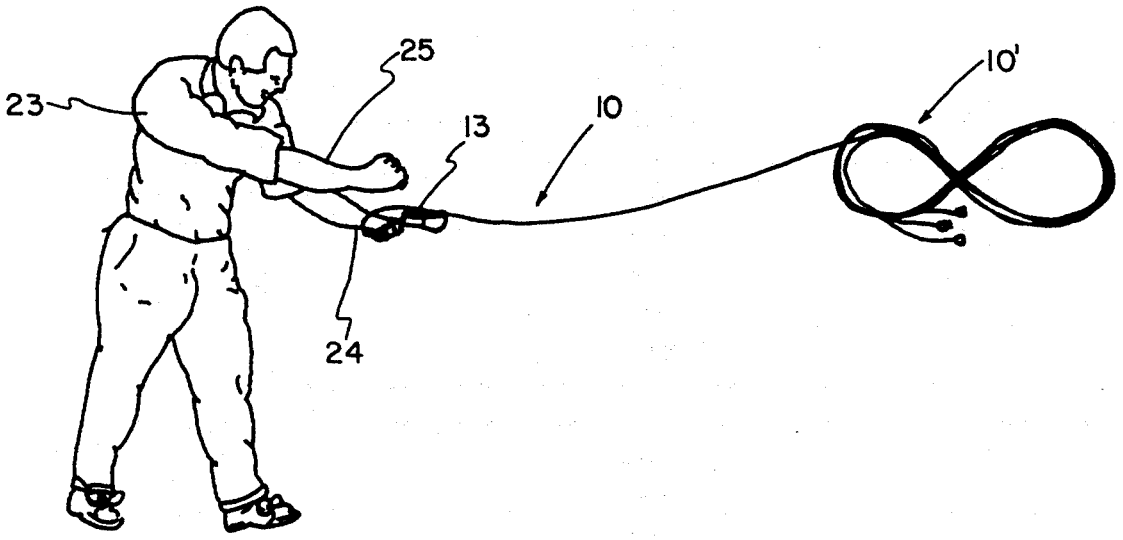
FIG. 4 is a perspective view of the power cord of the present invention being heaved to uncoil.
Figure 5:
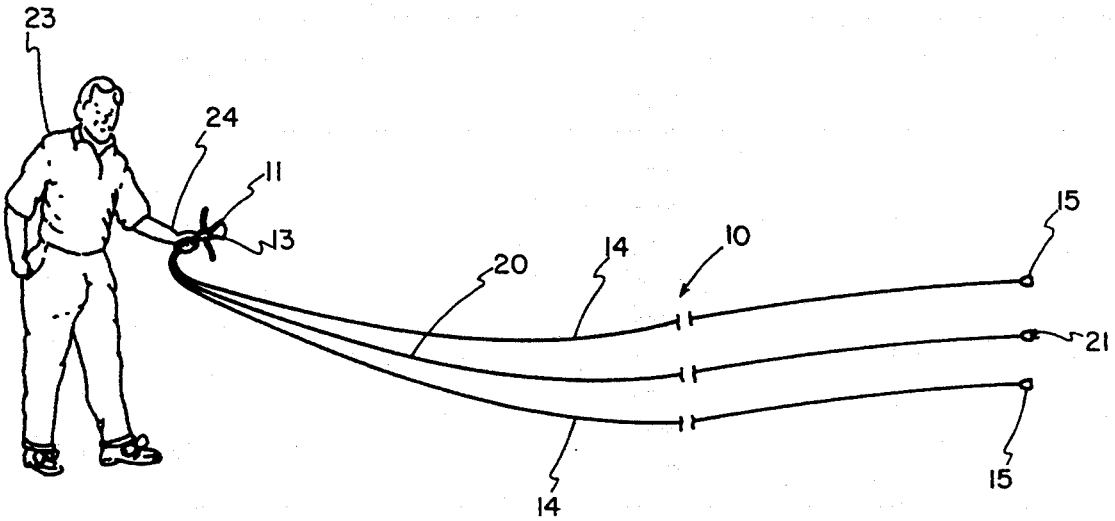
FIG. 5 is a perspective view of the power cord in the uncoiled position.
Figure 6:
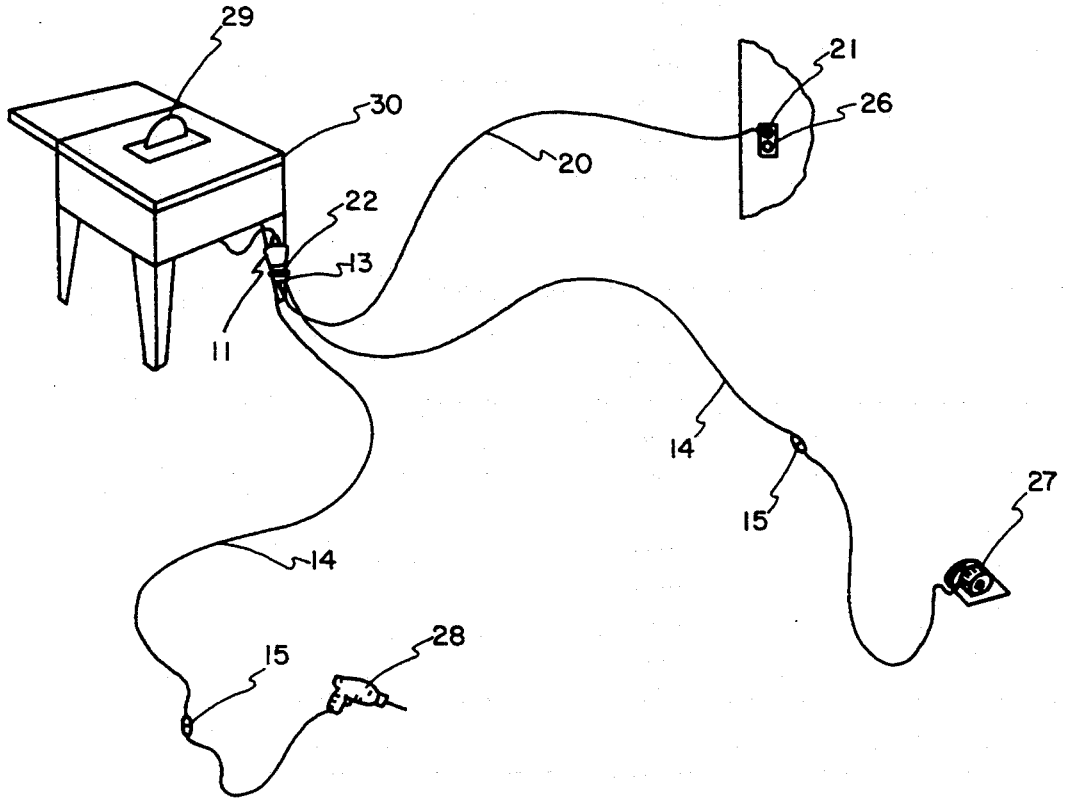
FIG. 6 shows power cord of the present invention in use.

Whenever it is desired to deploy the coiled improved power cord 10 of the present invention, the handle portion 10 is grasped in the left hand of righthanded user 23 and the Velcro strap 22 released. The coiled power cord 10 is held in the right hand as clearly shown in FIG. 3. With an underhand swing as shown in FIG. 4, the coil 10' is released from the right hand and will uncoil in basically a straight line laying the cord legs out to their full length. Usually, this uncoiling is done a distance approximately the same length as the cord legs from the power receptacle 26 and, of course, is thrown toward that receptacle.

In an example of use of the present invention, the user 23, after uncoiling the cord, would walk to the power receptacle 26 and plug male plug 21 thereinto. The user could then grasp the cords 14 adjacent receptacles 15 and pull such cords to their use areas. Either prior to inserting plug 21 into power receptacle 26 or thereafter, the Velcro strap 22 can be used to secure the head portion 11 and its associated handle portion 13 to the leg of a bench station 30 or similar desired location. If it is connected to a bench station then, of course, any power tools 29 associated therewith such as a bench saw, radial arm saw, or the like can be plugged into receptacles 12.

The receptacles 15 can be pulled to any desired location and connected to portable hand tools such as an electric hand saw 27 and electric drill 28.

If the equal length cord legs 14 are 40 feet long it can readily be seen that tools with cords can be operated over 80 feet from the power source 26. If, of course, the legs are just 10 feet longer making them 50 feet in length, then tools with cords can be operated over 100 feet from the power source.

Whenever it is time to take up the improved power cord 10 of the present invention, such as at the end of the workday or when the job is finished, the Velcro strip 22 is released from its secured position and the handle portion 13 is grasped in the forwardly extended left hand 24 of the user 23. The right hand 25 is then extended rearwardly and the cord grasped and pulled back to the left hand forming a coil. This process is repeated until the entire improved cord 10 has been taken up and is coiled is indicated at 10'. The Velcro strap 22 can then be wrapped around the coiled cord 10' and the same is ready for storage.

If a lefthanded user 23 is coiling the cord then, of course, the handle portion 13 would be grasped in the right hand and the left hand extended rearwardly to pick up the cords to coil the same.

Each of the cord legs are preferably colored differently either in solid colors or stripes. An example of this could be an orange service cord leg 20 extending from the power source 26 to the head portion 19. One of the two extension cord legs could be yellow and always be connected to a portable electric hand saw 27 with the other leg cord being green and always connected to an electric drill 28.

Three or more extension cord legs could, of course, be used in conjunction with the head portion 11. Also, a combination 110 volts AC and 220 volts AC could be made available through different female receptacles 12 in head portion 11.

From the above it can be seen that the present invention provides a highly-efficient improved power cord means that can be quickly and easily deployed for use without tangling. The cord means is also easy to coil for storage after being used.

The present invention means, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. An improved power cord comprising: a power source leg having a male plug at one end and communicatively attached to a head means at its other end; and at least one extension leg having a female plug at one end and being communicatively attached to said head means at its other end whereby said improved power cord can be coiled from the head means to the respective plugs and can also be deployed without tangling from the coiled position by holding said head means and heaving the coiled leg means away therefrom.

2. The improved power cord of claim 1 wherein at least two extension leg means are communicatively attached to said head means.

3. The improved power cord of claim 1 wherein said head means with its attached leg means is squid-shaped in configuration.

4. The improved power cord of claim 1 wherein at least one female plug is provided in said head means.

5. The improved power cord of claim 1 wherein a plurality of female plugs are provided in said head portion.

6. The improved power cord of claim 1 wherein said legs are generally of the same length from head to plug.

7. The improved power cord of claim 1 wherein a means is provided for holding the coiled legs in place.

8. The improved power cord of claim 7 wherein the coil holding means is a strap-like means.

9. The improved power cord of claim 8 wherein said strap-means is secured to said coiled leg portions by hook and loop-type material.

* * * * *